US008221172B2

(12) United States Patent
Ju et al.

(10) Patent No.: US 8,221,172 B2
(45) Date of Patent: Jul. 17, 2012

(54) ELECTRICAL CONNECTOR

(75) Inventors: Ted Ju, Keelung (TW); You Hua Cai, Keelung (TW); Zhu Dong Huo, Keelung (TW)

(73) Assignee: Lotes Co., Ltd., Keelung (TW)

( * ) Notice: Subject to any disclaimer, the term of this patent is extended or adjusted under 35 U.S.C. 154(b) by 105 days.

(21) Appl. No.: 12/967,190

(22) Filed: Dec. 14, 2010

(65) Prior Publication Data

US 2012/0058691 A1 Mar. 8, 2012

(30) Foreign Application Priority Data

Sep. 2, 2010 (CN) ..... 2010 2 0520092 U

(51) Int. Cl.
*H01R 13/02* (2006.01)

(52) U.S. Cl. ..... 439/884; 439/342

(58) Field of Classification Search ..... 439/83, 439/342, 856, 857, 884
See application file for complete search history.

(56) References Cited

U.S. PATENT DOCUMENTS 6,450,844 B1 * 9/2002 Mizumura et al. ..... 439/884
6,533,590 B1 * 3/2003 Lee et al. ..... 439/83
7,771,244 B1 * 8/2010 Ju ..... 439/857
7,828,562 B2 * 11/2010 Wu ..... 439/83
7,828,578 B1 * 11/2010 Ju ..... 439/342
8,016,623 B2 * 9/2011 Ju ..... 439/856
2010/0003868 A1 * 1/2010 Wu ..... 439/884
2011/0189898 A1 * 8/2011 Ju ..... 439/660
2012/0058691 A1 * 3/2012 Ju et al. ..... 439/751

* cited by examiner

*Primary Examiner* — James Harvey

(74) *Attorney, Agent, or Firm* — Morris Manning & Martin LLP; Tim Tingkang Xia, Esq.

(57) ABSTRACT

An electrical connector includes an insulating body, having at least one receiving housing running through the insulating body; at least one conductive member, comprising a contact portion disposed in the receiving housings, and has a middle part higher than two ends; a pair of first retaining arms, extending downwards from one end of the contact portion, wherein a retaining hole is formed between the two arms, and each of the two arms has a hook portion extending towards the retaining hole; a second retaining arm, extending downwards from the other end of the contact portion, wherein the second retaining arm extends towards the retaining hole, and has a width smaller than the retaining hole; and at least one solder ball, disposed in the receiving housing, received in the retaining hole, and pressed against by the two hook portions of the two first retaining arms and the second retaining arm.

12 Claims, 5 Drawing Sheets

ELECTRICAL CONNECTOR

CROSS-REFERENCE TO RELATED PATENT APPLICATION

This non-provisional application claims benefits and priority under 35 U.S.C. §119(a) on Patent Application No. 201020520092.3 filed in The People's Republic of China on Sep. 2, 2010, which is incorporated herein by reference in its entirety.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references, if any, listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector for electrically connecting a chip module to a circuit board.

BACKGROUND OF THE INVENTION

Chinese Patent No. CN200620115158.4 discloses an electrical connector, and each terminal includes a contact portion, an elastic arm, a support arm and a solder ball fixing device. The solder ball fixing device is formed by a first retaining portion, a second retaining portion and a stopping portion. The first retaining portion is connected to a bottom end of the elastic arm, the second retaining portion is connected to a bottom end of the support arm, and the first retaining portion and the second retaining portion extend downwards in parallel to form an accommodating space. Two clamps are formed at a bottom end of the first retaining portion, and the stopping portion is formed between the two clamps and bent to be perpendicular to the first retaining portion, and extends towards an interior of the accommodating space.

A solder ball can be retained in the solder ball fixing device by the first retaining portion, the second retaining portion and the stopping portion, and under the action of the stopping portion, the solder ball can be located in the same plane, thereby achieving electrical connection of the terminal to a circuit board.

However, currently available electrical connectors, such as the electrical connector disclosed in the patent set forth above, may have the following problems.

1. Since the two clamps are in the shape of a flat plate, and no fixing structure is disposed between the two clamps to prevent the solder ball from sliding down, the solder ball retained in the solder ball fixing device may slide down between the two clamps or fall off due to a large external force, thereby resulting in that the function of retaining and fixing the solder ball is not desirable.

2. Since the second retaining portion is vertically disposed, and the solder ball may have a surface tension, the second retaining portion cannot break the surface tension of the solder ball when the solder ball is melted by heating, and as a result, the solder ball is only softened, but cannot be completely melt and bonded to the first retaining portion and the second retaining portion, which may easily lead to an open solder connection or a cold solder joint, thereby resulting in poor electrical connection.

Therefore, a heretofore unaddressed need exists in the art to address the aforementioned deficiencies and inadequacies.

SUMMARY OF THE INVENTION

In one aspect, the present invention provides an electrical connector, which is configured to not only desirably retain and fix the solder ball to prevent the solder ball retained by the terminal from sliding down or falling off, but also prevent an open solder connection of the solder ball from happening, so as to improve the soldering effect.

In one embodiment, the present invention adopts the following inventive measures and provides an electrical connector that includes: an insulating body, having at least one receiving housing running through the insulating body; at least one conductive member, in which each of the conductive members has a contact portion disposed in one of the receiving housings, and the contact portion has a middle part higher than two ends thereof; a pair of first retaining arms, extending downwards from one end of the contact portion, in which a retaining hole is formed between the two first retaining arms, and each of the first retaining arms respectively has a hook portion extending towards the retaining hole; a second retaining arm, extending downwards from the other end of the contact portion, in which the second retaining arm extends towards the retaining hole, and the second retaining arm has a width smaller than the retaining hole; and at least one solder ball, in which each of the solder balls is correspondingly disposed in one of the receiving housings, received in the retaining hole, and at least pressed against by the two hook portions of the two first retaining arms and the second retaining arm.

As compared with the prior art, among other things, the electrical connector of the present invention is configured such that each of the first retaining arms respectively has a hook portion extending towards the retaining hole, the two hook portions fasten and fix the solder ball, so as to prevent the solder ball from sliding or falling off due to an external force; the second retaining arm is disposed inclined towards the retaining hole, and thus can break the surface tension of the solder ball, so as to facilitate melting of the solder ball, and at the same time, the second retaining arm inclinedly penetrates into the molten solder ball due to an elastic restoring force thereof, thereby improving the soldering performance of the electrical connector.

These and other aspects of the present invention will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The drawings described below are for illustration purposes only. The drawings are not intended to limit the scope of the present teachings in any way.

DETAILED DESCRIPTION OF THE PREFERRED EMBODIMENTS

Figure 1:
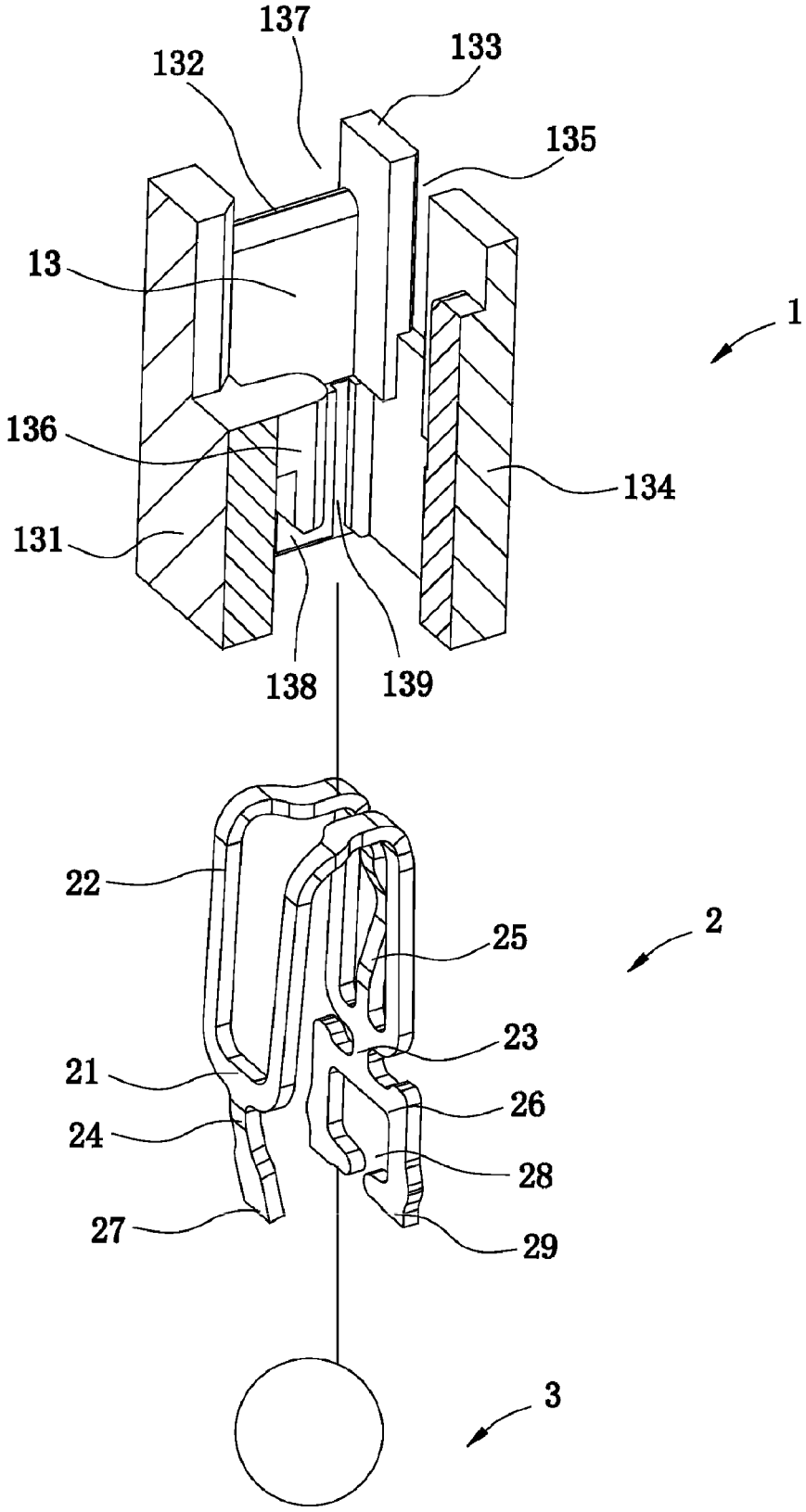
FIG. 1 is a three-dimensional exploded view of an electrical connector according to one embodiment of the present invention.
Figure 2:
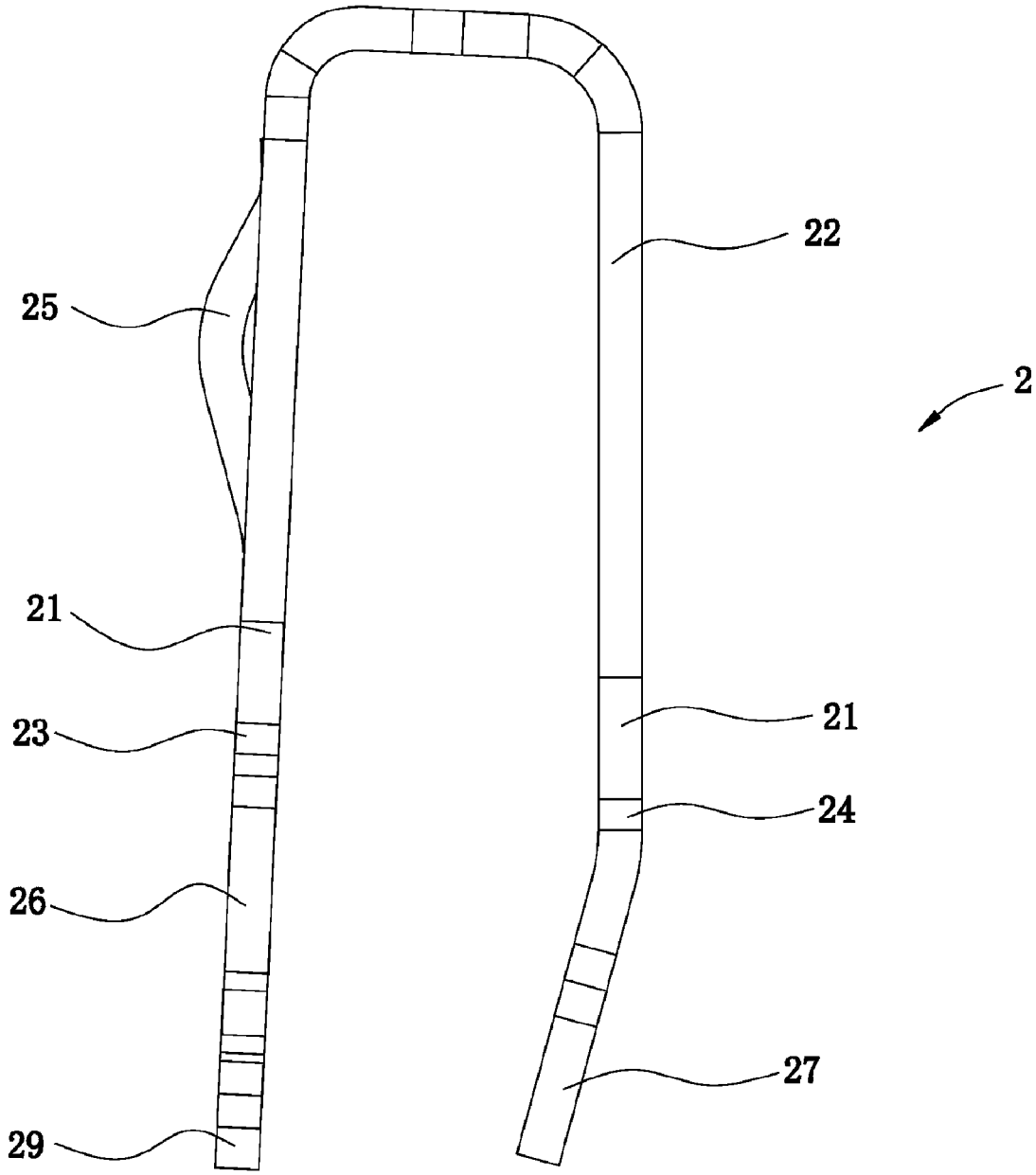
FIG. 2 is a side view of a terminal shown in FIG. 1.
Figure 3:
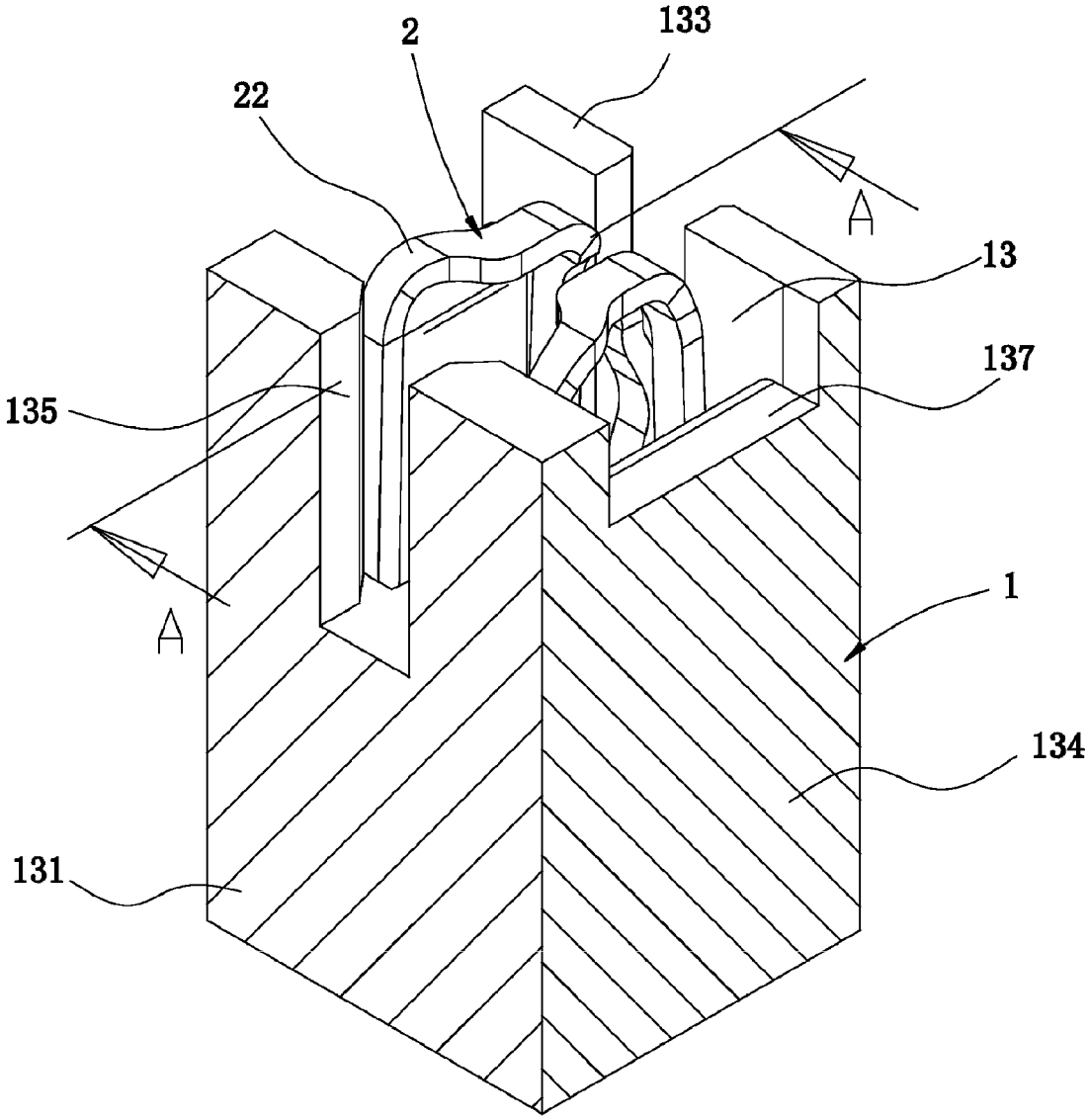
FIG. 3 is a three-dimensional assembled view of the electrical connector shown in FIG. 1.
Figure 4:
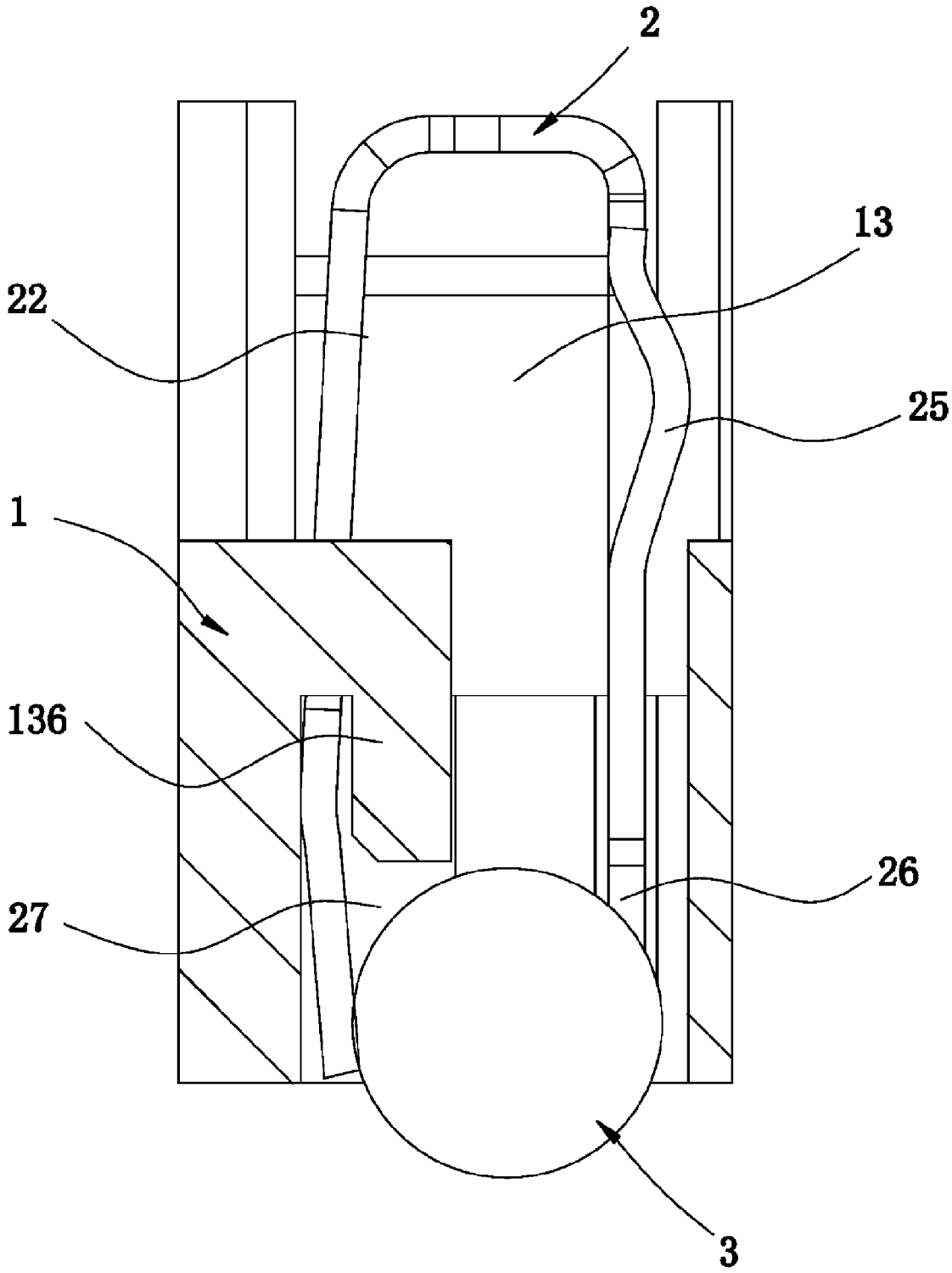
FIG. 4 is a sectional view along Line A-A in FIG. 3.

The present invention is more particularly described in the following examples that are intended as illustrative only since numerous modifications and variations therein will be apparent to those skilled in the art. Various embodiments of the invention are now described in detail. Referring to the drawings, FIGS. 1-5, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

DEFINITIONS

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

A list of reference numerals with corresponding components as shown in the drawings is given below only for the purpose of a reader's convenience:

| | | | | | |
|---|---|---|---|---|---|
| Insulating body | 1 | Top surface | 11 | Bottom surface | 12 |
| Receiving housing | 13 | First side wall | 131 | Second side wall | 132 |
| Third side wall | 133 | Fourth side wall | 134 | Notch | 135 |
| Protruding platform | 136 | Reserved space | 137 | Protruding block | 138 |
| Positioning groove | 139 | Conductive member | 2 | Contact portion | 21 |
| Arm portion | 22 | First bending portion | 23 | Second bending portion | 24 |
| Stopping arm | 25 | First retaining arm | 26 | Second retaining arm | 27 |
| Retaining hole | 28 | Hook portion | 29 | Solder ball | 3 |

Referring first to FIGS. 1 to 4, an electrical connector according to one embodiment of the present invention is shown, which can be used to connect a chip module (not shown) to a circuit board (not shown). The electrical connector includes an insulating body 1, and a plurality of conductive members 2 and a plurality of solder balls 3 disposed in the insulating body 1. For ease of description, only one receiving housing 13 in the insulating body 1, and one of the conductive members 2 and one of the solder balls 3 received in the receiving housing 13 are shown in the figures.

The insulating body 1 has a top surface 11 and a bottom surface 12 disposed opposite to each other, and a plurality of receiving housings 13 running through the top surface 11 and the bottom surface 12.

The receiving housing 13 has a first side wall 131, a second side wall 132, a third side wall 133 and a fourth side wall 134 connected to each other. The first side wall 131 and the third side wall 133 are disposed opposite to each other, and the second side wall 132 and the fourth side wall 134 are disposed opposite to each other, respectively.

A notch 135 is disposed at upper ends of the first side wall 131 and another is disposed at the third side wall 133, respectively. The notch 135 on the first side wall 131 is used for providing elastic deformation of a portion (that is, a stopping arm 25 described below) of the conductive member 2, and the notch 135 on the third side wall 133 is used for providing entrance of a pin of the chip module (not shown). A protruding platform 136 extends from the first side wall 131 towards the third side wall 133 and then extends downwards. The protruding platform 136 is located below the notch 135, and presses against the solder ball 3.

A reserved space 137 is formed on the second side wall 132 and the fourth side wall 134, respectively. A protruding block 138 is respectively disposed on the second side wall 132 and the fourth side wall 134. A positioning groove 139 is respectively disposed on the second side wall 132 adjacent to the third side wall 133 and on the third side wall 133 adjacent to the fourth side wall 134. The positioning groove 139 is located at the same side as the protruding block 138.

A conductive member 2 is disposed in the receiving housing 13, and has a contact portion 21. The contact portion 21 is Π-shaped, and has a middle part higher than two ends thereof. The middle part of the contact portion 21 is two arm portions 22 for retaining the pin.

A first bending portion 23 extends downwards from one end of the contact portion 21, and a second bending portion 24 extends downwards from the other end of the contact portion 21 opposite to the first bending portion 23. The first bending portion 23 and the second bending portion 24 are desirably elastic, and are capable of providing desirable elastic forces.

A stopping arm 25 extends upwards from an intersection of the first bending portion 23 and the contact portion 21. The stopping arm 25 is located between the two arm portions 22 to prevent the pin from excessive slipping.

A first retaining arm 26 respectively extends downwards from the left and right sides of the first bending portion 23. The two first retaining arms 26 are respectively engaged with the two positioning grooves 139. A retaining hole 28 is formed between the two first retaining arms 26. The retaining hole 28 is used for retaining the solder ball 3. Each of the first retaining arms 26 respectively has a hook portion 29 extending towards the retaining hole 28. A surface of the hook portion 29 facing the retaining hole 28 presses against the solder ball 3 to stop the solder ball 3 from sliding down, such that the solder ball 3 is maintained in the retaining hole 28. The first bending portion 23 has a width smaller than that of the two first retaining arms 26.

A second retaining arm 27 extends downwards from the second bending portion 24. The second retaining arm 27 is disposed inclined towards the retaining hole 28, and the second retaining arm 27 has a width smaller than that of the retaining hole 28. The second retaining arm 27 elastically presses against the solder ball 3 towards the first retaining arms 26, such that the solder ball 3 presses against the two hook portions 29 of the two first retaining arms 26 and the second retaining arm 27.

In other alternative embodiments, the two hook portions 29 may also be bent towards the second retaining arm 27.

Referring to FIG. 1, during assembly, first, the conductive member 2 is installed into the receiving housing 13 from bottom to top, such that the two first retaining arms 26 are received in the positioning grooves 139, and the two arm portions 22 at one end of the two first retaining arms 26 press against two sides of the notch 135 of the first side surface. The stopping arm 25 stops at the notch 135 and partially protrudes out of the notch 135, the protruding platform 136 protrudes between the two arm portions 22 and presses against the contact portion 21 at one end of the second retaining arm 27, and two sides of the protruding platform 136 are in contact with inner sides of the two arm portions 22.

Then, the solder ball 3 is installed into the conductive member 2, such that the solder ball 3 presses against the protruding blocks 138 of the third side wall 133 and the fourth side wall 134, the hook portions 29 of the two first retaining arms 26 fasten and hook the solder ball 3, and the second retaining arm 27 elastically presses against the solder ball 3 towards the first retaining arms 26.

Figure 5:
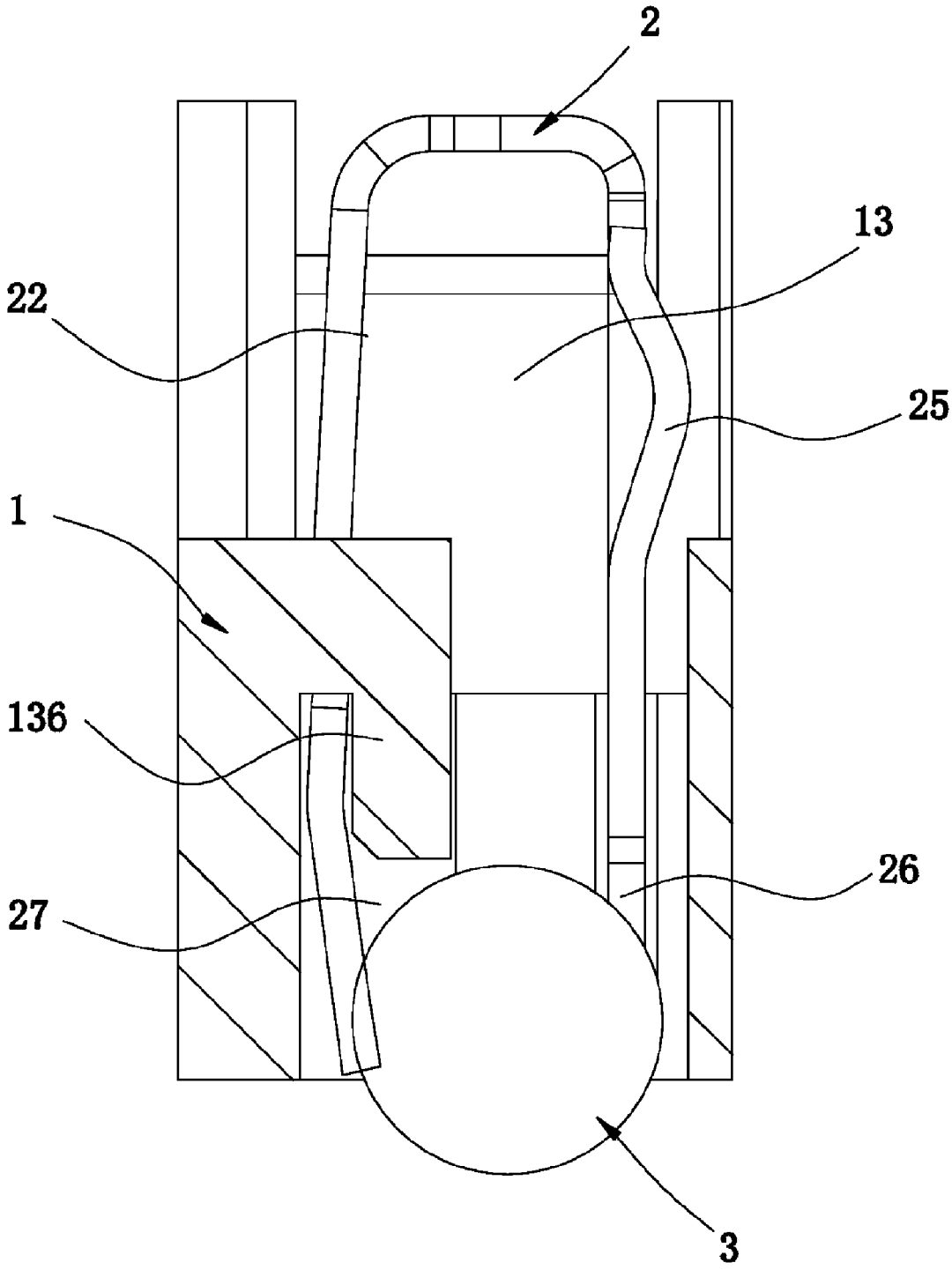
FIG. 5 schematically shows a state in which a solder ball in the electrical connector shown in FIG. 1. is melted.

Referring now to FIG. 5, when the solder ball 3 is melted such that the electrical connector is fixedly connected to the circuit board (not shown), since the second retaining arm 27 is disposed inclined, the second retaining arm 27 can break the surface tension of the solder ball 3, and penetrate into the solder ball 3 by about 10% of its length due to an elastic restoring force thereof, thereby improving the soldering performance of the electrical connector.

Accordingly, among other things, the electrical connector (s) of the present invention has the following advantages.

1. Since the two first retaining arms have the hook portions, the hook portions can desirably fasten and fix the solder ball when the solder ball is installed into the conductive member, so as to prevent the solder ball from sliding or falling off due to an external force, thereby achieving a desirable function of positioning the solder ball.

2. Since the second retaining arm is disposed inclined, the second retaining arm can break the surface tension of the solder ball when the solder ball is melted, and penetrate into the solder ball by about 10% of its length due to an elastic restoring force thereof, thereby ensuring desirable soldering between the solder ball and the retaining arm, and improving the soldering performance.

3. Since the conductive member has the bending portions, the pin, when being inserted into the conductive member, drives the two arm portions to shake left and right due to the high elasticity of the bending portions, so as to ensure that the two arm portions can contact the pin, and prevent the phenomenon that only one of the arm portions contacts the pin, and providing desirable electrical connection.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having at least one receiving housing formed through the insulating body;

at least one conductive member, wherein the at least one conductive member has:

a contact portion disposed in the at least one receiving housings, wherein the contact portion has a middle part higher than two ends thereof;

a pair of first retaining arms, extending downwards from one end of the contact portion, wherein a retaining hole is formed between the two first retaining arms, and each of the first retaining arms respectively has a hook portion extending towards the retaining hole; and a second retaining arm, extending downwards from the other end of the contact portion, wherein the second retaining arm extends towards the retaining hole, and the second retaining arm has a width smaller than the retaining hole; and at least one solder ball, correspondingly disposed in the at least one receiving housing, received in the retaining hole, and at least pressed against by the two hook portions of the pair of first retaining arms and the second retaining arm.

2. The electrical connector according to claim 1, wherein the pair of first retaining arms and the contact portion defines a first bending portion therebetween.

3. The electrical connector according to claim 2, wherein the first bending portion has a width smaller than that of the first retaining arm, and is resilient.

4. The electrical connector according to claim 3, wherein the first bending portion is elastic.

5. The electrical connector according to claim 1, wherein the second retaining arm and the contact portion define a second bending portion therebetween.

6. The electrical connector according to claim 5, wherein the second bending portion has a width smaller than the second retaining arm, and is resilient.

7. The electrical connector according to claim 6, wherein the resilient second bending portion is elastic.

8. The electrical connector according to claim 1, wherein when the solder ball is melted, at least 10% of the length of the second retaining arm penetrates into the solder ball.

9. The electrical connector according to claim 1, wherein a surface of the hook portion facing the retaining hole presses against the solder ball.

10. The electrical connector according to claim 1, wherein the middle part of the contact portion has two arm portions.

11. The electrical connector according to claim 1, wherein the two hook portions are bent towards the second retaining arm.

12. The electrical connector according to claim 1, wherein a stopping arm extends upwards from an intersection of the first retaining arm and the contact portion.

* * * * *